United States Patent [19]

Swank

[11] Patent Number: 4,573,751

[45] Date of Patent: Mar. 4, 1986

[54] COMBINATION MULTIPLE COMPARTMENT STORAGE BIN AND SORTING TRAY

[75] Inventor: Robert P. Swank, Mansfield, Ohio

[73] Assignee: Leiter Swank Industries, Inc., Lexington, Ohio

[21] Appl. No.: 607,507

[22] Filed: May 7, 1984

[51] Int. Cl.[4] ..... B65B 67/02; B65D 91/00

[52] U.S. Cl. ..... 312/211; 312/117; 312/120; 312/123; 312/326

[58] Field of Search ..... 312/117, 120, 123, 211, 312/326, 328, 18, 17

[56] References Cited

U.S. PATENT DOCUMENTS

| | | | |
|---|---|---|---|
| 207,967 | 9/1878 | Hudson | 312/328 |
| 246,873 | 9/1881 | Ducker | 312/120 |
| 354,421 | 12/1886 | Houser . | |
| 399,509 | 3/1889 | Ellithorpe . | |
| 614,827 | 11/1898 | Bonham | 312/211 |
| 645,504 | 3/1900 | Daggett . | |
| 658,983 | 10/1900 | Francis | 312/328 |
| 899,399 | 9/1908 | Hornig | 312/326 |
| 1,041,892 | 10/1912 | Sieling . | |
| 1,219,657 | 3/1917 | Melchert | 312/123 |
| 1,333,233 | 3/1920 | Ward . | |
| 1,937,337 | 11/1933 | Gaa | 312/211 |
| 2,205,572 | 6/1940 | McCann et al. . | |
| 2,343,042 | 2/1944 | Barry . | |
| 2,615,567 | 10/1952 | Campbell . | |
| 2,710,712 | 6/1955 | Friedman . | |
| 3,044,621 | 7/1962 | Pearlman et al. . | |
| 3,238,953 | 3/1966 | Barbie . | |
| 3,243,040 | 3/1966 | Cutter . | |
| 3,297,375 | 1/1967 | Reeves | 312/117 |
| 3,747,756 | 7/1973 | Wheeler . | |
| 4,162,112 | 7/1979 | Konkler | 312/18 |
| 4,298,157 | 11/1981 | DeVierno . | |
| 4,494,804 | 1/1985 | O'Keeffe | 312/211 |

FOREIGN PATENT DOCUMENTS

| | | | |
|---|---|---|---|
| 198655 | 5/1908 | Fed. Rep. of Germany | 312/211 |

*Primary Examiner*—Victor N. Sakran

*Attorney, Agent, or Firm*—Wood, Herron & Evans

[57] ABSTRACT

A combination multiple compartment storage bin and sorting tray is disclosed comprised of a frame adapted to hold a plurality of storage bins in a row between first and second oppositely disposed ends of said frame. The frame includes stacker means mounted on the first end for pushing all of the bins together and towards the second end after any one bin has been removed, thereby exposing a slot adjacent the first end into which the previously removed bin may be inserted. A sorting tray is mounted atop the frame for receiving articles from one of the storage bins. The tray is pivotally mounted about the top of the first end of the frame to pivot between a first horizontal position and a second angled position. The tray includes funnel means near the first end for facilitating egress of articles from the tray and into the slot as the tray is pivoted from the first position to the second position.

16 Claims, 4 Drawing Figures

COMBINATION MULTIPLE COMPARTMENT STORAGE BIN AND SORTING TRAY

BACKGROUND OF THE INVENTION

I. Field of the Invention

The present invention relates generally to apparatus for ease of sorting through a number ofarticles contained in one of a plurality of bins. Specifically, the present invention relates to apparatus specifically adapted to permit return of the articles to the appropriate bin after the articles have been sorted.

II. Description of the Prior Art

Often, a consumer, for example, wishes to select an item out of a storage bin containing many such items. Tyically, the consumer selects one of a number of storage bins, the bin selected being one holding the articles of interest to the consumer. To select the desired items from the bin, the consumer would either root through the contents of the bin or spill the contents out and sort through them.

The former is not desirable as weeding through the contents of the bin may result in undue damage to the articles and, likely, leaves the consumer dissatisfied. Accordingly, it is usually preferable and easier for the consumer to spill the contents out and sort through them.

To accommodate the consumer, it has been proposed to provide a tray which may be employed for the purposes of spilling out the contents and sorting through them. Such trays include a funnel or a chute in one end through which the articles may be poured to return them to their respective bin. Generally, such trays may be stored apart from the bins and may become lost. Hence, such trays are not always available when needed. Further, the user of such a tray has to be careful not to upset the tray while sorting through the articles else the articles may be accidentally strewn about the floor, for example. Additionally, proper utilization of such trays to return the articles to their bin is not always easily achieved due in part to the shifting weight of the articles in the tray as the tray is tipped to one side in order to pour the goods through the chute.

The present invention therefore has as an object to provide a tray which is not easily upset.

A further object of the present invention is to provide a tray which is kept integral with the bins.

An even further object of the present invention is to provide a tray which can be easily and reliably employed to return the articles to the bin.

SUMMARY OF THE INVENTION

To achieve the foregoing objects, and in accordance with the purposes of the invention as embodied and broadly described herein, a combination multiple compartment storage bin and sorting tray is provided which includes a frame having first and second oppositely disposed ends. The frameincludes a tray for receiving articles, which tray is pivotally mounted about the top of the first end of the frame to pivot between a first horizontal position and a second angled position. The tray includes an opening near the first end for facilitating egress of articles from the tray as it is pivoted from the first position to the second position. The frame is preferably adapted to hold a plurality of storage bins in a row between the first and second ends and includes stacker means mounted on the first end for pushing all of the bins together and towards the second end after any one bin has been removed, thereby exposing a slot at the first end into which the removed bin may be reinserted into the frame. Further, the frame preferably includes a chute mounted transversely across the first end of the frame and positioned adjacent the tray opening for blocking egress of articles from the tray through the funnel means when the tray is in its horizontal first position and for guiding articles into the slot as the tray is pivoted from the horizontal first position to the angled second position.

BRIEF DESCRIPTION OF THE DRAWINGS

The accompanying drawings,which are incorporated and constitute a part of this specification, illustrate a preferred embodiment of the invention and, together with a general description of the invention given above, and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit or scope of the invention.

DESCRIPTION OF THE PREFERRED EMBODIMENT

Reference will now be made in detail to the present preferred embodiment of the invention as illustrated in the accompanying drawings.

Figure 1:
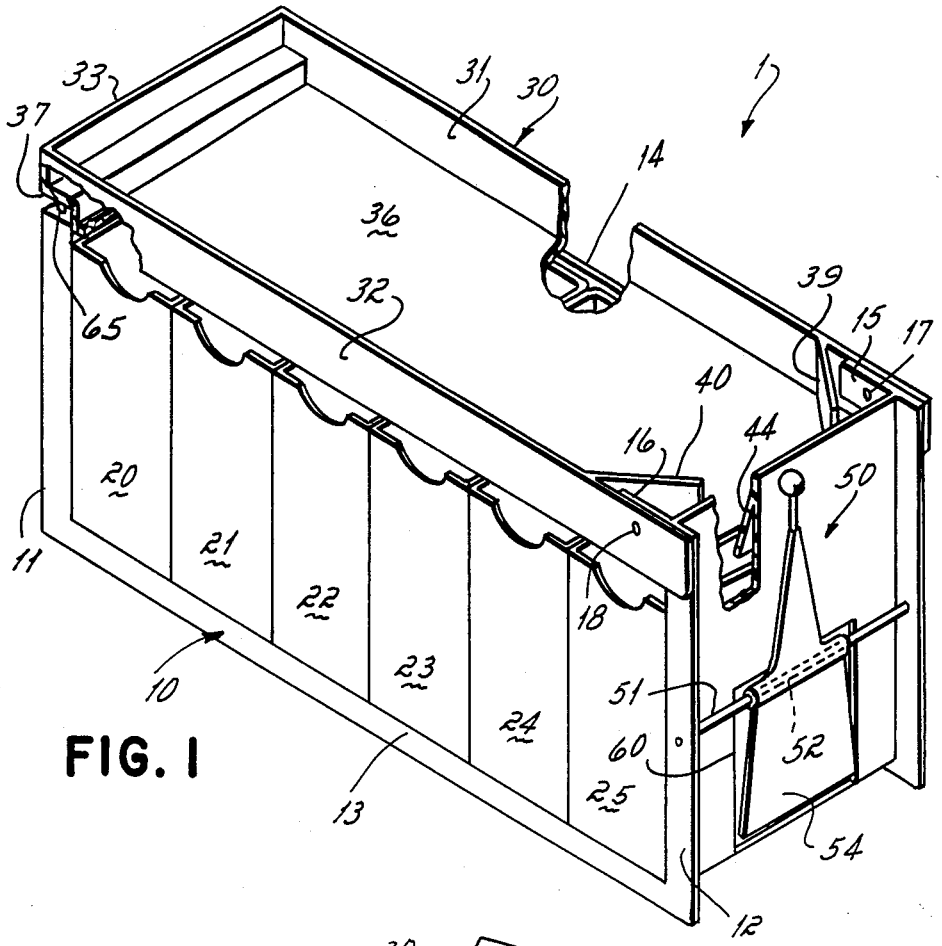
FIG. 1 is a perspective and partially cutaway view of a combination storage bin and sorting tray incorporating the teachings of the present invention.

In FIG. 1 there is illustrated one example of an apparatus generally denoted 1 incorporating the general teachings of the present invention. Apparatus 1 is comprised of an U-shaped frame 10 having a left wall or end 11 and an oppositely disposed wall or end 12 connected by a floor 13 and a rear wall 14 (shown in cutaway in FIG. 1)'wherein the walls 11, 12 and 14, and floor 13 are dimensioned such that they are adapted to hold a plurality of storage bins 20 through 25 between said oppositely disposed ends 11 and 12. Apparatus 1 further comprises a tray 30 having a rear wall 31 and a front wall 32 which are interconnected by left wall 33 thus forming a well 36. The right end of rear wall 31 is pivotally connected to a rear flange 15 which extends from the top of right wall 12 of the frame 10. Similarly, front wall 32 of tray 30 is pivotally mounted to forward flange 16 which extends from the top of right wall 12. The above pivotal connections are made by suitable connectors 17,18 such as bolts or rivets. In the above fashion, tray 30 is pivotally mounted about the top of end 12 and, thus, provides a tray which is kept integral with the frame 10 for storing the bins.

Figure 4:
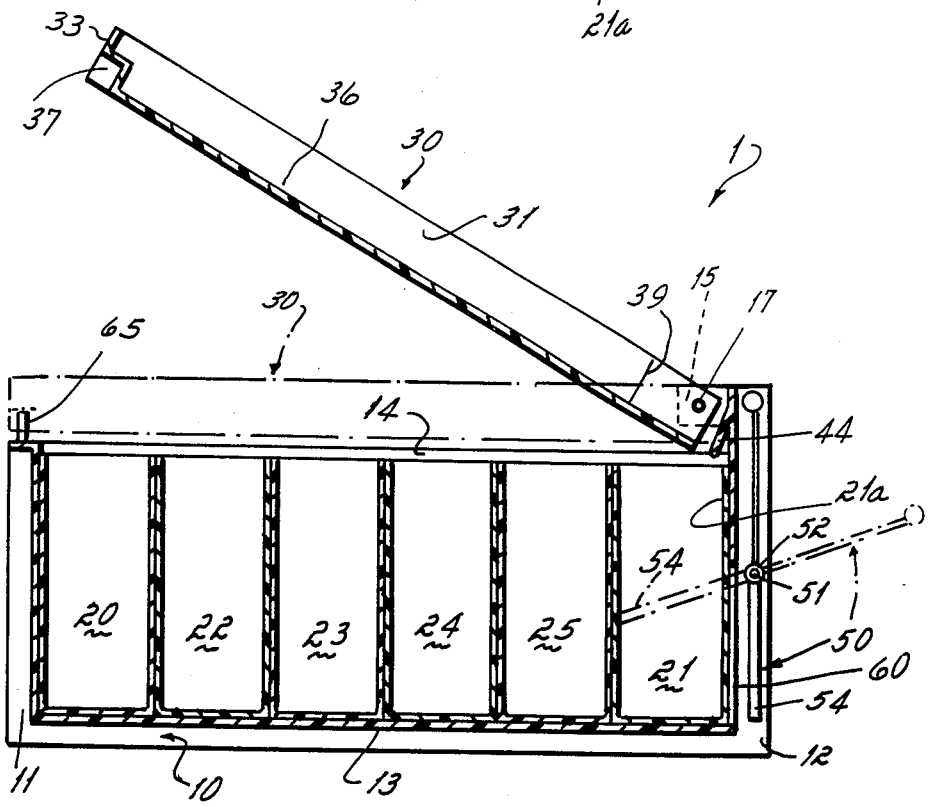
FIG. 4 is a cross sectional view of the apparatus of FIG. 1 showing operation of the tray to return the articles to the bin.

Included in left wall 33 of tray 30 is step 37 which, from the outside of the tray 30, forms a handle by which tray 30 may be moved from the horizontal position shown in FIG. 1 to the angled position shown in FIG. 4.

Tray 30 includes no right wall but when in the horizontal position shown in FIG. 1, the right end or opening of well 36 abuts an adjacent sloping wall 44 (shown in cutaway in FIG. 1 and also shown in FIG. 4) which is formed integral to and transversely across right wall 12 and depends from at or near the top thereof and over the top of the right wall 21*a* of bin 21 in FIG. 4. Included within the opening at the right end of well 36, and integral to tray 30 is rear funnel piece 39 and forward funnel piece 40 which act to facilitate egress of any articles situated in well 36 as tray 30 is pivoted as before described. Sloping wall 44 could, of course, be a piece added to right wall 12 and it is understood that "mounted" as used herein refers either to the added piece embodiment or the preferred, described integrally formed piece embodiment.

As can further be seen in FIG. 4, when tray 30 is pivoted to an angled position, the right end of well 36 no longer abuts sloping wall 44. Thus, funnel pieces 39 and 40 cooperate with sloping wall 44 which is now acting as a chute to guide egress of any articles which may have been in well 36. Hence, sloping or slanted wall 44 may be viewed as a chute means which blocks egress of articles from the tray 30 through the funnel formed by pieces 39 and 40 when the tray is in horizontal position while guiding articles from tray 30 when tray 30 is pivoted to an angled position.

As will be appreciated, tray 30 rests in the horizontal position such that left wall 33 is supported atop left wall 11 of frame 10. Further, it will be appreciated that the right ends of front and rear walls 31, 32 of tray 30 may contact the interior of right wall 12 of frame 10 and in certain circumstances may provide sufficient support for tray 30 such that left wall 11 of frame 10 need not project high enough to support left wall 33 of tray 30. However, because some of the articles which may be placed in tray 30 could become quite heavy, it is preferable that left wall 11 provide some support for tray 30 in the horizontal position. Furthermore, as shown in cutaway in FIG. 1, and in FIG. 4, left wall 11 preferably includes front and rear upstanding posts 65 (only front post 65 shown) which are received into mating slots (not shown)on tray 30 when the tray is in the horizontal position. By providing the above frame-tray combination, there is provided a sorting tray that is not easily upset and is easily and reliably employed to empty the articles therefrom.

Mounted to right wall 12 is stacker arm 50. Stacker arm 50 is mounted by means of a long rod 51 extending transversely across right wall 12 and through a bore 52 in stacker arm 50. Right wall 12 further has a slot at 60 through which the whole of bottom portion 54 (also referred to as an arm) of stacker arm 50 can be projected. Stacker arm 50 is urged towards an upright position as shown in FIG. 1 and in solid line in FIG. 4 because bottom portion 54 is heavier than the remaining portion of arm 50. Thus, gravity pulls downwardly on the portion 54 and causes arm 50 to take its normal upright position. Alternatively, a spring (not shown) could be employed. Stacker arm 50 may be pivoted towards the position shown in dotted line in FIG. 4 wherein arm 54 will extend into the cavity defined by frame 10.

Figure 2:
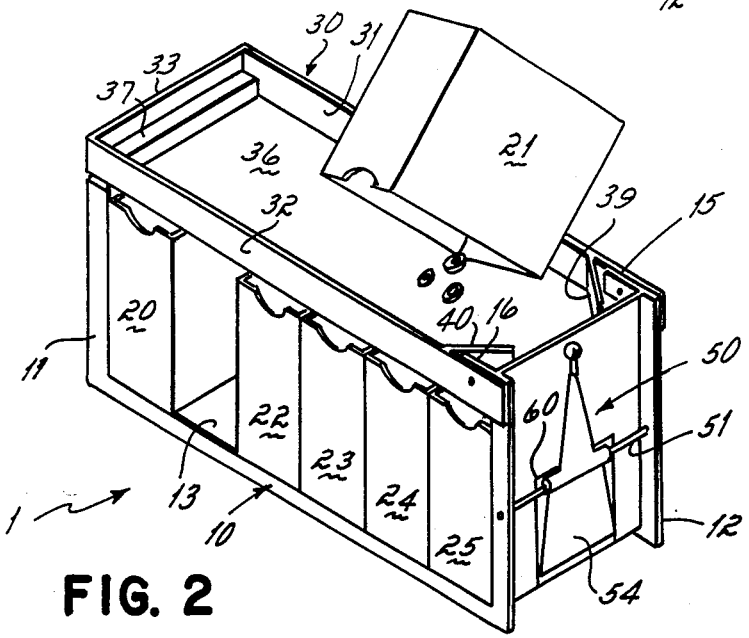
FIG. 2 is a perspective view of the apparatus of FIG. 1 with one bin shown withdrawn and the contents of the bin being poured into the tray.
Figure 3:
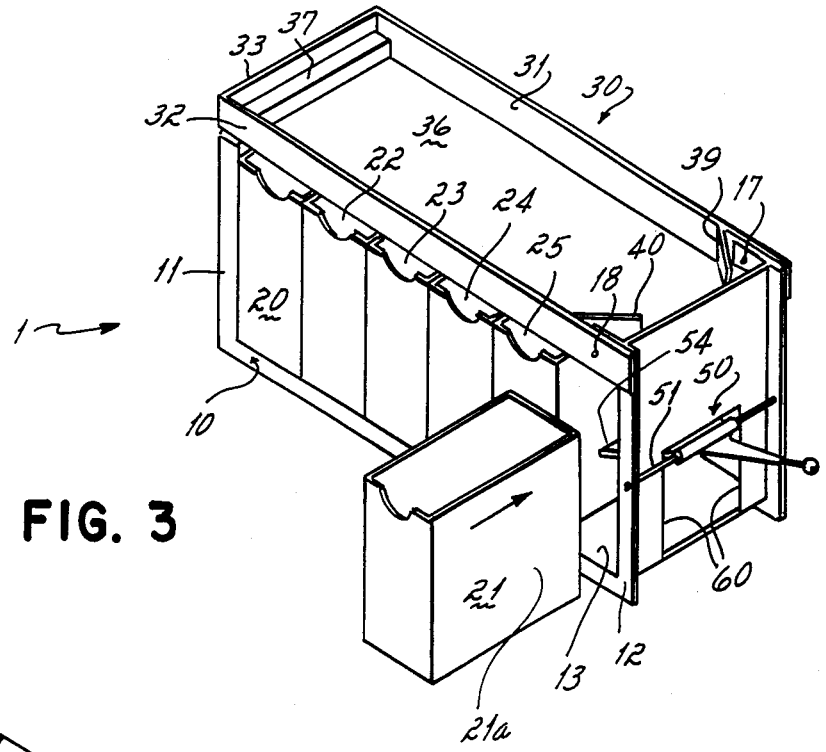
FIG. 3 is a perspective view of the apparatus of FIG. 1 showing the slot created by action of the stacker means.

When a user of apparatus 1 wishes to select a particular washer, for example, from bin 21, which is shown to contain washers in FIG. 2, he would remove bin 21 from the frame 10. The contents of bin 21 would then be poured into tray 30. The user could then sort through the washers selecting the desired washer(s). Once that is done and the desired washer is removed, the user performs a simple set of steps to return the washers to bin 21. First, stacker arm 50 is pivoted from the upright position to the dotted line position shown in FIG. 4. Arm 54 is sufficiently long so that as stacker arm 50 is pivoted, the rightmost end of bin 25 is contacted and pushed towards left wall 11 a distance sufficient to open a slot equal to the width of bin 21. In so doing, bins 22, 23, and 24 are likewise moved towards left wall 11. Once stacker arm 50 has moved bins 22 through 25 as far as they will go towards left wall 11 as shown in FIG. 3, the stacker arm 50 may be released in which case gravity will urge arm 54 out of the slot previously created as discussed above. Bin 21 may then be inserted into the aforementioned slot. (Of course, the foregoing could also be done before selecting the desired product.) Once bin 21 is inserted, and the desired product selected, the user needs merely to lift tray 30 by means of the handle formed by step 37 from the horizontal to the angled position as previously discussed. Funnel pieces 39 and 40 and sloping wall 44 will cooperate to guide the washers into bin 21 which has been replaced in the previously formed slot. Accordingly, the washers will be easily and reliably returned to their appropriate bin.

Additional advantages and modifications will readily appear to those skilled in the art. The invention in its broader aspects is therefore not limited to the specific details, representative apparatus, and illustrative example shown and described. Accordingly, departures may be made from such details without departing from the spirit or scope of applicant's general inventive concept.

I claim:

1. Apparatus for sorting comprising:

a frame having first and second oppositely disposed generally horizontal end walls;

said frame including tray means for receiving articles;

said tray means being pivotally mounted about the top of said first end wall of said frame to pivot between a first horizontal position and a second angled position;

said frame end walls defining a receiving area therebetween for articles;

said tray means including egress means near said first end wall and overlying a portion of said receiving area for facilitating egress of said articles from said tray means into said receiving area as said tray means is pivoted from said first position to said second position;

chute means mounted transversely across said first end wall of said frame and positioned adjacent said tray egress means and cooperating therewith for blocking egress of said articles from said tray means through said egress means when said tray means is in said first position and for guiding said articles into said receiving area as said tray means is pivoted from said first position to said second position.

2. The apparatus of claim 1 wherein said egress means includes a pair of oppositely angled walls projecting upwardly from the floor of said tray and said chute means comprises a slanted wall section of said first end wall of said frame.

3. The apparatus of claim 2 wherein the free end of said tray means rests atop and is supported by said second end wall of said frame when said tray means is in said first position.

4. A multiple compartment storage bin and sorting tray comprising:

a frame having first and second oppositely disposed generally horizontal end walls;

said frame including tray means for receiving articles;

said tray means being pivotally mounted about the top of said first end wall to pivot between a first horizontal position and a second angled position;

a plurality of removable bins supported by said frame, at least one said bin being positioned beneath a portion of said tray means;

said tray means including egress means near said first end wall and overlying said one bin for facilitating egress of said articles from said tray means and into said one bin as said tray means is pivoted from said first position to said second position;

chute means mounted transversely across said first end wall of said frame and positioned adjacent said tray egress means and cooperating therewith for blocking egress of said articles from said tray means through said egress means when said tray means is in said first position and for guiding said articles into said one bin as said tray means is pivoted from said first position to said second position.

5. The multiple compartment storage bin and sorting tray of claim 4 wherein said egress means includes a pair of oppositely angled walls projecting upwardly from the floor of said tray and said chute means comprises a slanted wall section of said first end wall of said frame.

6. The multiple compartment storage bin and sorting tray of claim 5 wherein the free end of said tray means rests atop and is supported by said second end wall of said frame when said tray means is in said first position.

7. The multiple compartment storage bin and sorting tray of claim 4 wherein said bins are aligned in one row between said end walls of said frame.

8. A multiple compartment storage bin and sorting tray comprising a frame adapted to hold a plurality of storage bins in at least one row between first and second oppositely disposed end walls of said frame, said frame including stacker means mounted on said first end wall for pushing all of the bins together and towards said second end wall after any one bin has been removed thereby exposing a slot adjacent said first end wall into which said removed bin is insertable, said frame further including tray means for receiving articles, said tray means being pivotally mounted about the top of said first end wall to pivot between a first horizontal position and a second angled position, said tray means including egress means near said first end wall and overlying a portion of said slot for facilitating egress of said articles from said tray means and into said slot as said tray means is pivoted from said first position to said second position;

chute means mounted transversely across said first end wall of said frame and positioned adjacent said egress means and cooperating therewith for blocking egress of said articles from said tray means through said egress means when said tray means is in its first position and for guiding said articles into said slot as said tray means is pivoted from said first position to said second position.

9. The multiple compartment storage bin and sorting tray of claim 8 wherein said egress means includes a pair of oppositely angled wall pieces projecting upwardly from the floor of said tray and said chute means comprises a slanted wall section of said first end wall of said frame.

10. The multiple compartment storage bin and sorting tray of claim 9 wherein the free end of said tray means rests atop and is supported by said second end wall of said frame when said tray means is in said first position.

11. The multiple compartment storage bin and sorting tray of claim 8 wherein said stacker means includes an arm which extends into said slot in a second position to push said bins towards said second end wall, said slot being free of said arm when said arm is in a first position.

12. The multiple compartment storage bin and sorting tray of claim 11 wherein said arm is urged to said first position.

13. The multiple compartment storage bin and sorting tray of claim 12 wherein said arm is sufficiently heavy to permit gravity to urge said arm to said first position.

14. The multiple compartment storage bin and sorting tray of claim 8 wherein said slot formed by said stacker means is spaced substantially equal to the width of said removed bin.

15. The multiple compartment storage bin and sorting tray of claim 8 wherein said rows are only one in number.

16. The multiple compartment storage bin and sorting tray of claim 15 wherein said bins are each substantially alike in size and shape.

* * * * *